United States Patent [19]

Johnson

[11] 4,192,166

[45] Mar. 11, 1980

[54] DECORATED METAL OBJECTS DRAWN FROM DECORATED BLANKS

[75] Inventor: Robert M. Johnson, Providence, R.I.

[73] Assignee: Reed and Barton Corporation, Taunton, Mass.

[21] Appl. No.: 861,612

[22] Filed: Dec. 19, 1977

[51] Int. Cl.[2] ..... B21D 22/00

[52] U.S. Cl. ..... 72/347; 72/379; 113/116 Z; 113/116 J

[58] Field of Search ..... 113/116 R, 116 J, 116 Y, 113/116 Z; 72/347, 379, 377

[56] References Cited

U.S. PATENT DOCUMENTS

| | | | |
|---|---|---|---|
| 309,531 | 12/1884 | Eades | 113/116 Z |
| 413,373 | 10/1889 | Paull | 113/116 Z |
| 1,717,482 | 6/1929 | Weidlech et al. | 113/116 Z X |

FOREIGN PATENT DOCUMENTS

| | | | |
|---|---|---|---|
| 544561 | 7/1922 | France | 113/116 Z |
| 799433 | 6/1936 | France | 113/116 F |

*Primary Examiner*—Leon Gilden

*Attorney, Agent, or Firm*—Thompson, Birch, Gauthier & Samuels

[57] ABSTRACT

Methods are described for producing novel shaped objects drawn from sheet metal blanks having a surface design in one or more decorative metals of contrasting color. The design is applied to the flat metal blank with distortions which substantially compensate for the metal deformation in forming the object from the blank.

7 Claims, 10 Drawing Figures

DECORATED METAL OBJECTS DRAWN FROM DECORATED BLANKS

BACKGROUND OF THE INVENTION

In U.S. Pat. No. 3,503,815 I have described techniques for producing on a base metal designs in one or more contrasting decorative metals, and the disclosure thereof is incorporated herein by reference.

The procedures disclosed in the above-identified patent use photographic exposures of photoresist materials. In practice, these are applied to flat blanks or discs, and the designs developed thereon, prior to drawing to form the objects. Since the drawing or shaping of the blanks deforms the metals and distorts the designs, the use of such plated designs has been generally limited to objects of shallow draft or curvature.

It is the principal object of the present invention to provide improved methods which substantially avoid the foregoing limitation and which permit metal decoration to be applied attractively to more deeply shaped articles such as bells, goblets, bowls, cups, pitchers and the like.

SUMMARY OF THE INVENTION

The decorated objects of the present invention are made by providing a sheet metal blank of a size suitable for forming the object, forming the design on the blank in decorative metal with distortions substantially compensating for the metal deformation in forming the object from the blank, and thereafter forming the object from the decorated blank by drawing or the like. Preferably, the design distortions are formed in the design on the blank by providing an undistorted grid of intersecting lines on the blank, drawing the blank into the shape of the object to distort the grid lines according to the deformation of the metal in forming the object, preparing a flat representation of at least that portion of the distorted grid on the portion of the article surface to be decorated, applying at least the outline of each color of the desired design to the flat representation, and transferring the design to the undistorted grid by locating portions of the design intersecting the distorted grid line distortions at the corresponding grid line intersections of the undistorted grid. The resulting distorted design is then reproduced over a base metal blank in decorative plated metals by any suitable technique as illustrated in the above identified patent or hereinafter.

DESCRIPTION OF PREFERRED EMBODIMENTS

The accompanying drawings illustrate techniques according to the present invention for providing metallic designs on deeply drawn objects. To facilitate understanding, the Figures are approximately to scale, with the exception of FIGS. 2 and 8 which are somewhat enlarged and exaggerated for clarity.

Figure 1:
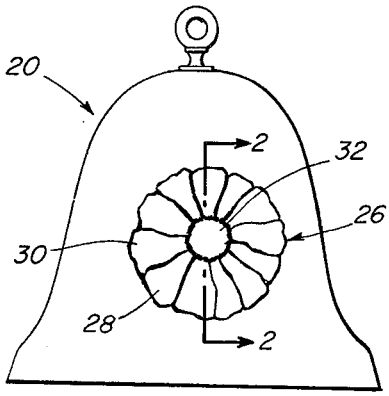
FIG. 1 is a front elevation of a bell decorated with a floral design in decorative metals of contrasting colors.
Figure 2:
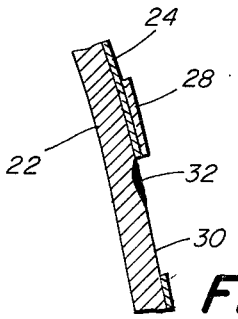
FIG. 2 is a section on the line 2—2 of FIG. 1.

The decorative article illustrated in FIGS. 1 and 2 comprises a bell 20 of a brass base metal 22 which has been overplated with silver 24 and which is decorated on its side wall with three equally spaced floral patterns 26. The pattern 26 illustrated comprises alternate petals of copper 28 and brass 30, the petals being outlined in black nickel, and having a black nickel center 32. The pattern is applied as more fully explained hereinafter by selective plating and by overall plating and etching techniques to a flat blank of brass overplated with silver which is subsequently drawn with dies or the like to form the bell. While a simple floral pattern is illustrated for clarity, more elaborate scenes or artistic designs are contemplated and are readily provided by the techniques described.

Since photographic exposure techniques are employed in creating the design, no feasible way is known for applying the art work directly to the side wall of the shaped article. Also, where substantial metal deformation is involved in forming the final article from a flat blank, unaltered art work applied to the blank will undergo unacceptable distortion when formed into the final shaped article. Accordingly, the present invention provides techniques for developing the art work on the flat blank with compensating distortions which are substantially eliminated during drawing to provide a final design of substantially the desired configuration.

Figure 3:
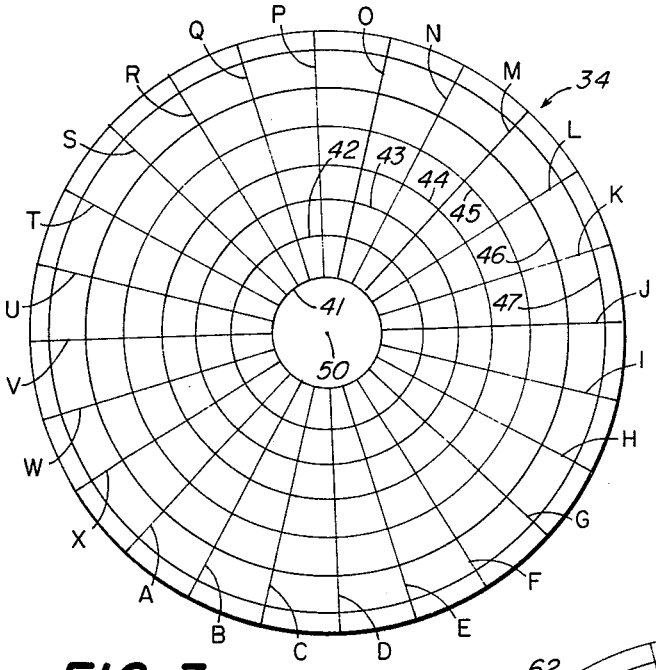
FIG. 3 is a plan view of a flat metal blank suitable for drawing the bell shown in FIG. 1 and which is provided with a grid of intersecting lines.
Figure 4:
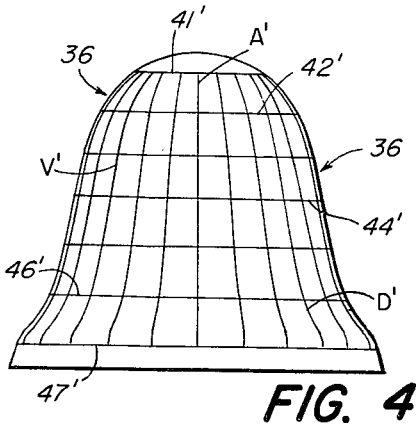
FIG. 4 is a front elevation of the blank shown in FIG. 3 after drawing to the shape of the bell shown in FIG. 1.

As shown in FIG. 3, there is initially provided a metal blank 34 of a size and shape suitable for drawing into the desired final object. This blank is provided with a grid of intersecting lines. The preferred grid illustrated comprises a series of concentric closed lines 41–47 and a series of radial lines A–X extending from the center of the blank 50 to the outer concentric line 47. The concentric closed lines 41–47 preferably comprise lines of the shape of successive horizontal sections of the final shaped article desired, in the case of the bell illustrated, circles. The blank 34 with the grid applied thereto is then drawn to the shape of the desired object as illustrated in FIG. 4, for example with dies. As a result of the drawing, the grid lines on the blank 34 are distorted in accordance with the deformation of the metal in the blank during forming.

Figure 6:
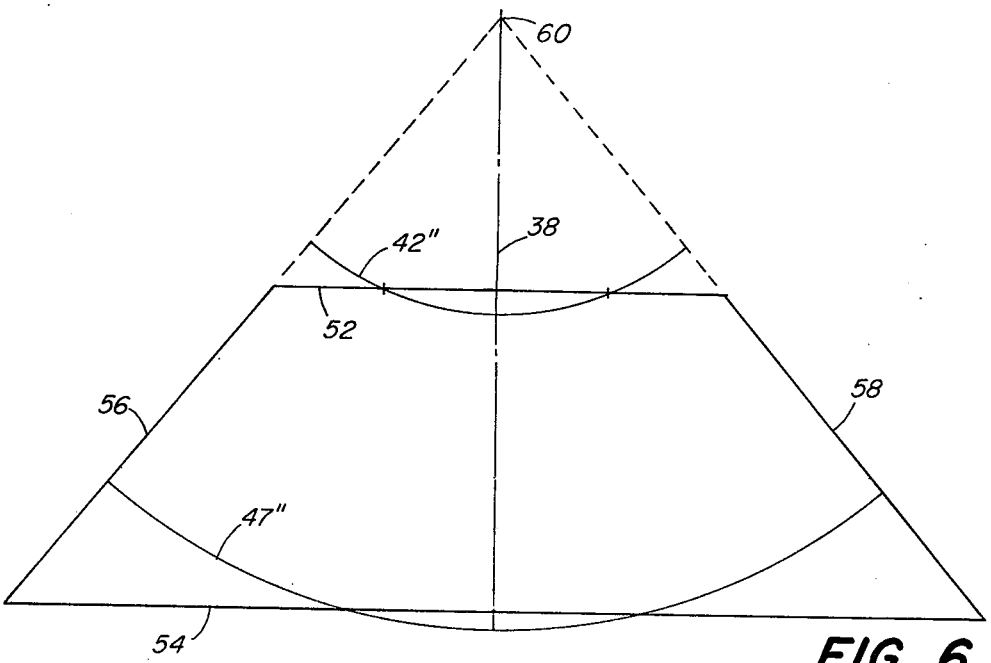
FIG. 6 is an illustration in plan of a construction technique for preparing a flat representation of that portion of the drawn surface of the bell shown in FIG. 4 to which the floral design is to be applied.
Figure 7:
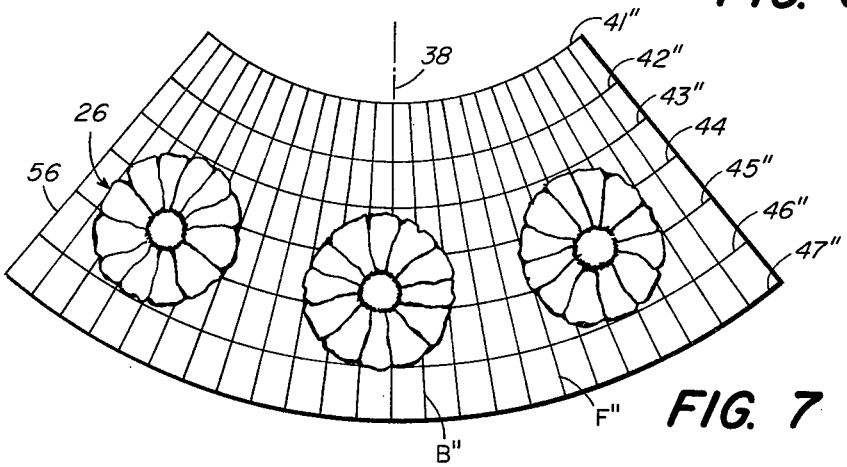
FIG. 7 is a view similar to FIG. 6 to which has been added the additional grid lines of the bell surface and to which has been applied the undistorted floral design.

The next step comprises preparing a flat representation of the distorted grid pattern on the drawn object 36 as shown in FIG. 4 wherein the corresponding grid lines are shown with primes. The preferred procedure is illustrated in FIGS. 6 and 7 prepared as follows. Two concentric lines on the shaped blank 36 are selected, one on either side of the area to be decorated, for example concentric circles 42' and 47'. Their circumferential length is measured and their distance apart on the surface along one of the radial lines A' is measured. Referring to FIG. 6, a straight center line 38 is erected and two lines 52 and 54 erected perpendicularly thereto of a length corresponding, respectively, to the circumferential length of concentric lines 42' and 47', and separated apart along their centerline 38 by a distance equal to their separation along the line A' on the shaped object 36. Adjacent ends of the respective lines 52 and 54 are connected with straight lines 56 and 58 which are extended to determine their point of intersection 60 on the centerline 38. From point 60 as the center of curvature, an arc 42" is drawn having an arc length approximately the same as line 52, and the remaining arcs 43"–47" are added from point 60 at a spacing along centerline 38 equal to the spacing of lines 43'–47' along line A' on drawn blank 36. For most objects, arc 42" may be drawn as shown through the midpoints of each half of line 52, although any other point or points along line 52 may be used which will give an arc length of approximately the correct length.

The radial lines A'–X' are represented as radial lines A"–X" emanating from the point 60, centerline 38 representing one of the lines, for example A" and the lines 56 and 58 representing the opposite radial line M", with the intervening radial lines being added at equal spacings. It will be noted that for a conical surface, the flat surface representation is substantially accurate whereas for compoundly curved tapered objects, the representation is only approximate.

Figure 5:
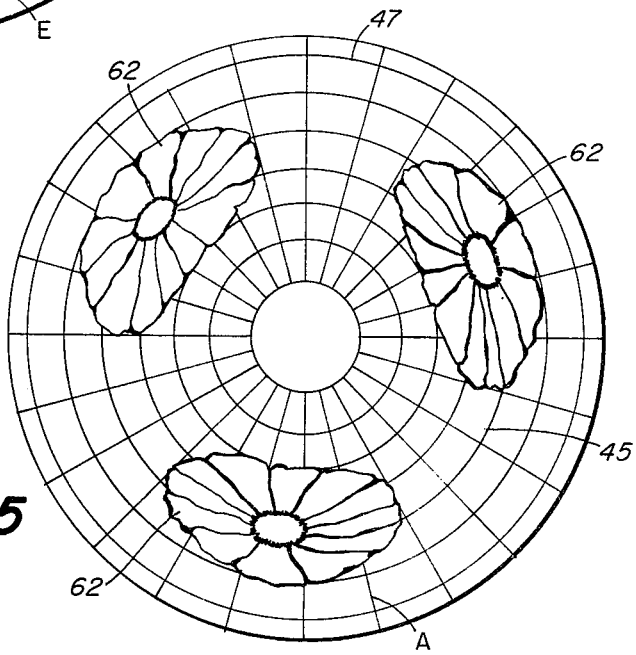
FIG. 5 is a plan view of the blank shown in FIG. 3 to which the floral design of the bell shown in FIG. 1 has been applied in a distorted form which, after drawing, will produce the substantially undistorted design on the drawn bell.

Following preparation of the distorted grid represented in FIG. 7, the desired design without distortion is then added to the distorted grid representation as shown in FIG. 7. These figures are then transferred to the original grid as shown in FIG. 5, portions of the design at distorted grid intersections on FIG. 7 being transferred to the corresponding grid intersections of FIG. 5, with the intervening portions of the design being completed free hand to provide a distorted design as also shown in FIG. 5. For multicolor designs, the portions of the distorted designs 62 in each color are marked and color separations prepared for use in etching and plating as described in the foregoing patent and hereinafter. Distorted designs 62 may be prepared on a metal blank if desired, or on a paper representation as desired.

Figure 8:
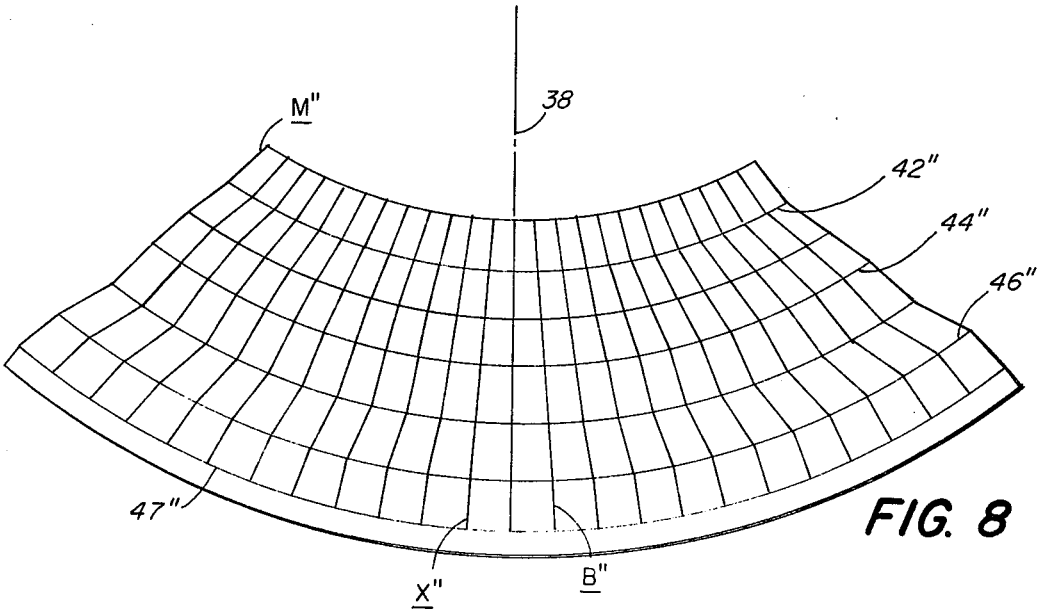
FIG. 8 is an alternative representation of the grid pattern shown in FIG. 7.

FIG. 8 illustrates a slightly modified technique for preparing the flat distorted grid representation shown in FIG. 7. In FIG. 8 arcs 42" through 47" are prepared as described in FIG. 7. The actual distance along each concentric line 42'–47' to each radial line A'–X' is then measured on article 36 and marked off on arcs 42"–47", the arcs being extended where necessary, the points being then connected as shown in FIG. 8 to form modified radial lines A" to X". The modified constructions thereby obtained provides a somewhat better flat representation of tapered surfaces having compound curvature. The undistorted design is then applied to the FIG. 8 representation and transferred to the undistorted original grid as previously described. For most objects and designs, the representation of FIG. 7 is adequate.

Figure 9:
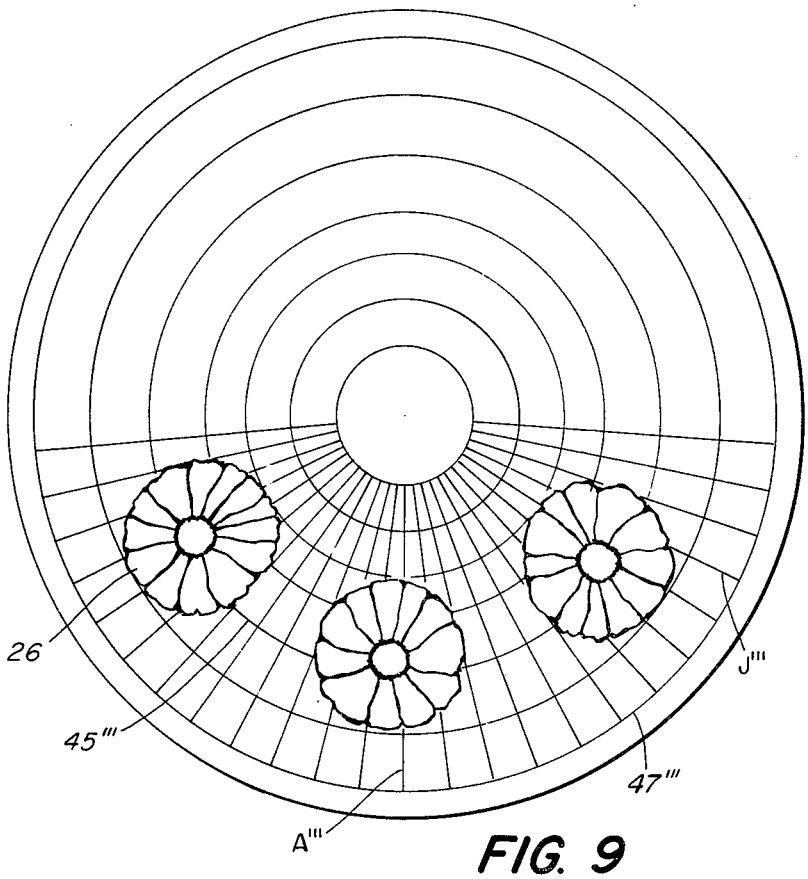
FIG. 9 is a plan view showing an alternative flat representation of the distorted surface of the drawn bell of FIG. 4 to which the undistorted floral design has been applied; and, FIG. 10 is an alternative construction to FIG. 9 providing additional compensation for more extreme side wall curvatures in the bell.
Figure 10:
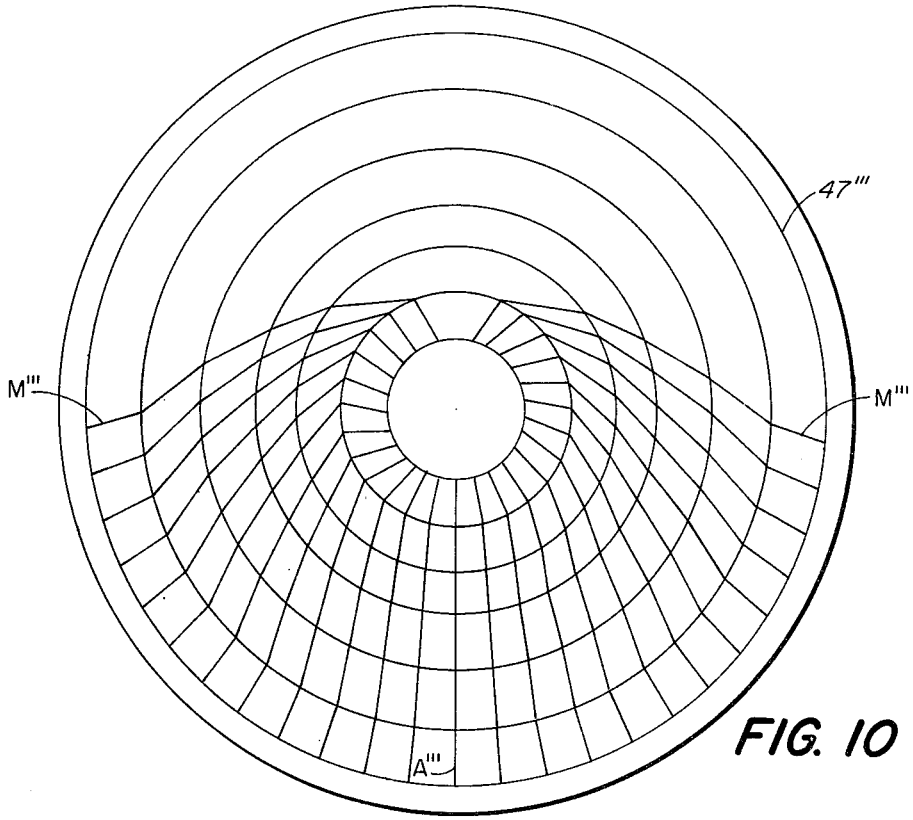

Modified techniques for preparing a flat representation of the distorted grid on the surface of shaped article 36 are shown in FIGS. 9 and 10. The representation shown in FIG. 9 is constructed as follows. A concentric line on the shaped article 36 below the area to be decorated, for example the line 47' is selected and the maximum surface dimension perpendicular to that line between opposed points on that line is measured. An enlarged line 47''' is then constructed of the same shape wherein opposed points are separated by the measured distance. In the case of the bell illustrated having circular cross-sections, the distance measured is over the top of the bell and is represented as the diameter of the circle 47'''. The smaller concentric circles are constructed in a similar manner. The circumferential length of the line 47' is measured and an arc of equal length along the enlarged circle 47''' is marked. That arc is then divided into intervals equal to the number of radial lines in the original undistorted grid and those lines added from the center of the enlarged line 47''' to the portions of the arcs so marked. The design 26 is then applied to the representation without distortion and transferred to the original grid using corresponding grid intersections as previously described.

A modification of the FIG. 9 procedure is shown in FIG. 10 wherein one of the radial lines A' is shown as a straight line from the center to the periphery of the enlarged line 47'''. The distances from that radial line to the remaining lines on either side thereof are measured for each concentric line on the shaped object 36, those distances marked on the corresponding concentric lines of FIG. 10, and the resulting points connected to form lines A''' to X''' as shown. When the original design 26 is applied to this modified representation of the distorted grid, greater accuracy is obtained in correcting design distortions in forming objects having substantial compound curvature.

Following preparation of the distorted design 62, a color separation photograph, either negative or positive depending on the nature of the photoresist and whether the corresponding metal is to be obtained by etching or by direct plating, is prepared for each color. After such distorted color separations are prepared, they may be employed to provide the metallic design as described in my above patent or other similar technique. As disclosed in the patent, overall plating followed by etching unwanted metal is often more precise and artistic for many metals and is therefore often preferred. However, the desired metal pattern can also be obtained by selectively plating the desired metal over the base directly in the desired pattern.

As an illustration of a procedure suitable for obtaining the design shown in FIGS. 1 and 2, the following steps may be employed. A flat brass blank or disc of suitable size and shape, is plated first with silver, for example to one mil in thickness, and then with copper, for example to a thickness of one-half mil. After cleaning, the blank is coated with a first photoresist, for example Photoresist Number 3 of the Eastman Kodak Company, which is thereafter baked in an oven for approximately three minutes. The baked resist is then exposed to light through a negative color separation film which exposes and hardens the resist over the desired copper image areas. The unexposed resist is then removed with solvent, for example trichloroethylene, and the copper thus exposed is etched away with a ferric chloride solution which does not affect silver. After rinsing in water, the exposed resist is removed with a chemical stripper and the blank again cleaned.

The brass and black nickel portions of the design are then prepared by removing the overlying silver as follows. After cleaning, the blank with the etched copper design is again coated with a photoresist which is exposed through a negative color separation which hardens the resist over silver areas to be retained, care being exercised to register the silver color separation with the preceding copper separation. The unexposed resist is then removed and the reverse side of the blank covered with a protective coating to protect the silver on the reverse side from etchant. The exposed silver over the desired brass image is then etched away in a potassium cyanide water solution which does not attack brass. The cyanide solution is then removed by washing and the resist material removed with a stripper, for example a stripper containing acetone.

The black center of the design and the outline around the copper and brass petals is then developed by the following procedure. After cleaning, the blank is again coated with a photoresist and exposed through a registered negative image of the desired black design, and the unexposed resist removed. The exposed brass is then etched to a depth of approximately 5 mils with a ferric chloride solution, overlying silver and copper having been removed in the preceding steps. Again, the silver plating on the reverse side of the blank is protected from etching by means of a suitable protective coating. Black nickel is then electroplated onto the brass areas just etched, but to a depth of less than 5 mils, leaving the black nickel below the surface of the other metals to give a relief effect and to protect it from subsequent polishing operations. All resist and protective materials are then removed, the blank carefully cleaned and inspected, and the object then formed by drawing or the like into the shape of the bell.

While the foregoing illustration employs etching to obtain the brass and copper portions of the design, such portions may also be obtained by direct plating. For example, gold may be electroplated to obtain the yellow portions of the design. Suitable black nickel plating solutions and procedures are known and are disclosed, for example on page 210, Composition 2, of the Electroplating Engineering Handbook, Edited by Graham and Pinkerton, Reinhold Publishing Corp., 1955.

While the foregoing description and drawings describe a bell of substantially circular cross-section, it should be understood that the present invention and procedures can be applied to other tapered shapes which can be formed by forming from a flat blank. It can be applied for example to goblets, bowls, and the like and to pitchers or similar articles which are formed from two tapered halves subsequently joined. In addition to circular cross-sections, such objects may have oval, polygonal or other similar sections. Forming is usually by drawing with dies but may be performed by other techniques such as spinning or by combinations thereof.

It should be further understood that the foregoing description is for the purpose of illustration and that the invention includes all equivalents and modifications within the scope of the appended claims.

What is claimed is:

1. The method of making a shaped metal object drawn from a sheet metal blank of a base metal having thereover a design in one or more decorative metals, said method comprising:

(a) providing a flat metal blank of a size suitable for forming said object, (b) forming on said blank an undistorted grid of intersecting lines, (c) drawing said blank into the shape of said object to distort the grid lines according to the deformation of the metal in forming the object, (d) preparing a flat representation of at least that portion of the distorted grid on the portion of the object surface to be decorated, (e) applying at least the outline of each color of the desired design to said flat representation, (f) transferring the design from said representation to said undistorted grid by locating portions of the design intersecting the distorted grid line intersections at the corresponding grid line intersections on the undistorted grid, thereby forming a distorted design, (g) reproducing said distorted design in decorative metal on a flat blank of said base metal, and (h) drawing said decorated blank to form said object.

2. The method according to claim 1 wherein said undistorted grid of intersecting lines comprises a plurality of radial lines and a plurality of closed concentric lines each of which has the shape of a cross-section of said article.

3. The method according to claim 2 wherein said objects are tapered and bell-shaped, and wherein said concentric lines are substantially circular.

4. The method according to claim 3 wherein said flat representation of the distorted grid is prepared by measuring the circumferential length and separating distance of at least two of said distorted concentric lines on the drawn blank (c) which include between them the area of the article surface to be decorated, plotting straight lines perpendicular to a centerline at said length and spacing, joining the adjacent ends of said lines and extending the joining lines to define their point of intersection on said centerline, joining the opposed ends of each of said straight lines with an arc having its center of curvature at said point, the arcs representing said concentric grid lines, adding the intermediate concentric lines as arcs from said point at substantially their actual spacing on the formed blank (c), one of said radial lines being represented by said centerline, and adding the remaining radial lines along said arcs.

5. The method according to claim 4 wherein said flat representation of the distorted grid is prepared by measuring the maximum surface distance of the drawn blank (c) between opposed points on one lower concentric closed line beneath the article area to be decorated, said distance being substantially perpendicular to said concentric line, plotting on a flat surface an enlarged concentric line having the shape of said one lower concentric line with said opposed points separated by said distance, drawing a radial line from said points on said enlarged concentric line through the center thereof, adding the remaining concentric lines at substantially their actual spacing along the surface of drawn blank (c), measuring the circumferential length of said one concentric line on the drawn blank (c) and marking said length along said enlarged concentric line centered on said radial line, and adding the remaining radial lines to said representation between the ends of the arc length so marked.

6. The method according to claim 5 wherein said radial lines are drawn from said center at equal distances apart along said arc length.

7. The method according to claim 5 wherein said additional radial lines are spaced apart along each enlarged concentric line by their actual spacing along each such line on the shaped blank (c).

* * * * *